US006312078B1

(12) United States Patent
Wen

(10) Patent No.: US 6,312,078 B1
(45) **Date of Patent: *Nov. 6, 2001**

(54) IMAGING APPARATUS AND METHOD OF PROVIDING IMAGES OF UNIFORM PRINT DENSITY

(75) Inventor: Xin Wen, Rochester, NY (US)

(73) Assignee: Eastman Kodak Company, Rochester, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/826,353

(22) Filed: Mar. 26, 1997

(51) Int. Cl.[7] ..... B41J 29/38
(52) U.S. Cl. ..... 347/12; 347/14
(58) Field of Search ..... 347/12, 14, 13, 347/57, 58, 15, 19

(56) References Cited

U.S. PATENT DOCUMENTS

| | | | | |
|---|---|---|---|---|
| 3,946,398 | | 3/1976 | Kyser et al. . | |
| 4,166,277 | | 8/1979 | Cielo et al. . | |
| 4,275,290 | | 6/1981 | Cielo et al. . | |
| 4,353,079 | | 10/1982 | Kawanabe . | |
| 4,490,728 | | 12/1984 | Vaught et al. . | |
| 4,746,935 | | 5/1988 | Allen . | |
| 4,751,531 | | 6/1988 | Saito et al. . | |
| 4,908,635 | * | 3/1990 | Iwasawa et al. | 347/14 |
| 4,999,646 | | 3/1991 | Trask . | |
| 5,038,208 | | 8/1991 | Ichikawa et al. . | |
| 5,157,411 | * | 10/1992 | Takehoshi et al. | 347/13 |
| 5,172,142 | | 12/1992 | Watanabe et al. . | |
| 5,343,231 | | 8/1994 | Suzuki . | |
| 5,412,410 | | 5/1995 | Rezanka . | |
| 5,521,621 | | 5/1996 | Endo et al. . | |
| 5,808,639 | * | 10/1998 | Silverbrook | 347/57 |

FOREIGN PATENT DOCUMENTS

| | | |
|---|---|---|
| 0 288 044 A | 10/1988 | (EP) . |
| 0 421 806 A2 | 4/1991 | (EP) . |
| 0 468 075 A1 | 1/1992 | (EP) . |
| 0 649 746 A1 | 4/1995 | (EP) . |
| 0 709 213 A2 | 5/1996 | (EP) . |
| 0 750 988 A2 | 1/1997 | (EP) . |
| 07 323578 | 12/1995 | (JP) . |
| WO 96 32289 | 10/1996 | (WO) . |

* cited by examiner

*Primary Examiner*—John Barlow
*Assistant Examiner*—Charles W. Stewart, Jr.
(74) *Attorney, Agent, or Firm*—Walter S. Stevens

(57) ABSTRACT

Imaging apparatus and method for providing images of uniform print density. The apparatus includes a print head having a plurality of nozzles containing ink. Each nozzle has an image forming characteristic, such as print density, associated therewith. A heater associated with each nozzle is in heat transfer communication with the ink for heating the ink, so that, as the ink is heated, its surface tension relaxes. As surface tension relaxes, static back-pressure acting on the ink ejects the ink from the nozzle. A voltage supply unit is provided for supplying a voltage pulse to each of the heaters for activating the heaters and a controller interconnects the heaters and the voltage supply unit for controlling the voltage pulse. Controlling the voltage pulse causes the image forming characteristic for each nozzle to be altered to the extent that the image forming characteristics for all the heaters will become uniform. In this regard, the controller includes a memory unit capable of informing the controller of the voltage pulse duration to be applied to each heater for obtaining uniform image forming characteristics. Alternatively, the memory unit may inform the controller of the pulse amplitude to be applied to each heater for obtaining uniform image forming characteristics. Therefore, either the voltage pulse amplitude or the voltage pulse duration applied to each heater is controlled such that the image forming characteristics (e.g., print densities) of all nozzles are uniform.

13 Claims, 18 Drawing Sheets

230

| | Nozzle #1 | Nozzle #2 | | Nozzle #N-2 | Nozzle #N-1 | Nozzle #N |
|---|---|---|---|---|---|---|
| $D_1$ | $V_{p,1}$ | $V_{p,2}$ | | $V_{p,N-2}$ | $V_{p,N-1}$ | $V_{p,N}$ |
| $D_2$ | $V_{p,1}$ | $V_{p2}$ | | $V_{pN-2}$ | $V_{p,N-1}$ | $V_{p,N}$ |
| | | | | | | |
| $D_{W-1}$ | $V_{p,1}$ | $V_{p,2}$ | | $V_{p,N-2}$ | $V_{p,N-1}$ | $V_{p,N}$ |
| $D_W$ | $V_{p,1}$ | $V_{p,2}$ | | $V_{p,N-2}$ | $V_{p,N-1}$ | $V_{p,N}$ |

Fig. 14

240

| | Nozzle # 1 | Nozzle # 2 | | | Nozzle # N-2 | Nozzle # N-1 | Nozzle N |
|---|---|---|---|---|---|---|---|
| $D_1$ | $T_1$ | $T_2$ | | | $T_{N-2}$ | $T_{N-1}$ | $T_N$ |
| $D_2$ | $T_1$ | $T_2$ | | | $T_{N-2}$ | $T_{N-1}$ | $T_N$ |
| | | | | | | | |
| $D_{W-1}$ | $T_1$ | $T_2$ | | | $T_{N-2}$ | $T_{N-1}$ | $T_N$ |
| $D_W$ | $T_1$ | $T_2$ | | | $T_{N-2}$ | $T_{N-1}$ | $T_N$ |

Fig. 15

IMAGING APPARATUS AND METHOD OF PROVIDING IMAGES OF UNIFORM PRINT DENSITY

CROSS-REFERENCE TO RELATED APPLICATIONS

Reference is made to commonly assigned, copending U.S. patent application Ser. No. 08/783,256 filed Jan. 14, 1997 and commonly assigned, copending U.S. patent application Ser. No. 08/826,357 filed Mar. 26, 1997 both in the name of Xin Wen.

FIELD OF THE INVENTION

The present invention relates generally to imaging apparatus and methods and, more particularly, to an imaging apparatus and method for providing images of uniform print density, so that printing non-uniformities, such as banding, are avoided.

BACKGROUND OF THE INVENTION

In a typical ink jet printer using a multi-nozzle head, digital signals as to each of four colors (i.e., red, green, blue and black) regarding an image are processed in a manner so that the multi-nozzle head forms a printed color image on a recorder medium, such as paper or transparencies.

Indeed, ink jet printing has become recognized as a prominent contender in the digitally controlled, electronic printing arena because, e.g., of its non-impact, low-noise characteristics, its use of plain paper and its avoidance of toner transfers and fixing. Ink jet printing mechanisms can be categorized as either continuous ink jet or drop-on-demand ink jet. U.S. Pat. No. 3,946,398, which issued to Kyser et al. in 1970, discloses a drop-on-demand ink jet printer which applies a high voltage to a piezoelectric crystal, causing the crystal to bend, applying pressure on an ink reservoir and jetting drops on demand. Other types of piezoelectric drop-on-demand printers utilize piezoelectric crystals in push mode, shear mode, and squeeze mode. Piezoelectric drop-on-demand printers have achieved commercial success at image resolutions up to 720 dpi for home and office printers. However, piezoelectric printing mechanisms usually require complex high voltage drive circuitry and bulky piezoelectric crystal arrays, which are disadvantageous in regard to manufacturability and performance.

Great Britain Pat No. 2,007,162, which issued to Endo et al. in 1979, discloses an electrothermal drop-on-demand ink jet printer which applies a power pulse to an electrothermal heater which is in thermal contact with water based ink in a nozzle. A small quantity of ink rapidly evaporates, forming a bubble which cause drops of ink to be ejected from small apertures along the edge of the heater substrate. This technology is known as Bubblejet™ (trademark of Canon K.K. of Japan).

U.S. Pat. No. 4,490,728, which issued to Vaught et al. in 1982, discloses an electrothermal drop ejection system which also operates by bubble formation to eject drops in a direction normal to the plane of the heater substrate. As used herein, the term "thermal ink jet" is used to refer to both this system and system commonly known as Bubblejet™.

Thermal ink jet printing typically requires a heater energy of approximately 20 $\mu$J over a period of approximately 2 $\mu$sec to heat the ink to a temperature between 280° C. and 400° C. to cause rapid, homogeneous formation of a bubble. The rapid bubble formation provides the momentum for drop ejection. The collapse of the bubble causes a tremendous pressure pulse on the thin film heater materials due to the implosion of the bubble. The high temperatures needed necessitates the use of special inks, complicates the driver electronics, and precipitates deterioration of heater elements. The 10 Watt active power consumption of each heater is one of many factors preventing the manufacture of low cost high speed pagewidth printheads.

U.S. Pat. No. 4,275,290, which issued to Cielo et al., discloses a liquid ink printing system in which ink is supplied to a reservoir at a predetermined pressure and retained in orifices by surface tension until the surface tension is reduced by heat from an electrically energized resistive heater, which causes ink to issue from the orifice and to thereby contact a paper receiver. This system requires that the ink be designed so as to exhibit a change, preferably large, in surface tension with temperature. The paper receiver must also be in close proximity to the orifice in order to separate the drop from the orifice.

U.S. Pat. No. 4,166,277, which also issued to Cielo et al., discloses a related liquid ink printing system in which ink is supplied to a reservoir at a predetermined pressure and retained in orifices by surface tension. The surface tension is overcome by the electrostatic force produced by a voltage applied to one or more electrodes which lie in an array above the ink orifices, causing ink to be ejected from selected orifices and to contact a paper receiver. The extent of ejection is claimed to be very small in the above Cielo patents, as opposed to an "ink jet", contact with the paper being the primary means of printing an ink drop. This system is disadvantageous, in that a plurality of high voltages must be controlled and communicated to the electrode array. Also, the electric fields between neighboring electrodes interfere with one another. Further, the fields required are larger than desired to prevent arcing, and the variable characteristics of the paper receiver such as thickness or dampness can cause the applied field to vary.

In U.S. Pat. No. 4,751,531, which issued to Saito, a heater is located below the meniscus of ink contained between two opposing walls. The heater causes, in conjunction with an electrostatic field applied by an electrode located near the heater, the ejection of an ink drop. There are a plurality of heater/electrode pairs, but there is no orifice array. The force on the ink causing drop ejection is produced by the electric field, but this force is alone insufficient to cause drop ejection. That is, the heat from the heater is also required to reduce either the viscous drag and/or the surface tension of the ink in the vicinity of the heater before the electric field force is sufficient to cause drop ejection. The use of an electrostatic force alone requires high voltages. This system is thus disadvantageous in that a plurality of high voltages must be controlled and communicated to the electrode array. Also the lack of an orifice array reduces the density and controllability of ejected drops.

Each of the above-described ink jet printing systems has advantages and disadvantages. However, there remains a widely recognized need for an improved ink jet printing approach, providing advantages for example, as to cost, speed, quality, reliability, power usage, simplicity of construction and operation, durability and consumables.

Commonly assigned U.S. patent application Ser. No. 08/750,438 entitled A LIQUID INK PRINTING APPARATUS AND SYSTEM filed in the name of Kia Silverbrook on Dec. 3, 1996, discloses a liquid printing system that affords significant improvements toward overcoming the prior art problems associated with drop size and placement accuracy, attainable printing speeds, power usage, durability, thermal stresses, other printer performance characteristics, manufacturability, and characteristics of useful inks. Silverbrook provides a drop-on-demand printing mechanism wherein the means of selecting drops to be printed produces a difference in position between selected drops and drops which are not selected, but which is insufficient to cause the ink drops to overcome the ink surface tension and separate from the body of ink, and wherein an additional means is provided to cause separation of said selected drops from said body of ink. Several drop separation techniques are disclosed by Silverbrook, the following table entitled "Drop separation means" shows some of the possible methods for separating selected drops from the body of ink, and ensuring that the selected drops form dots on the printing medium. The drop separation means discriminates between selected drops and un-selected drops to ensure that un-selected drops do not form dots on the printing medium.

Drop separation means

| Means | Advantage | Limitation |
|---|---|---|
| 1. Electrostatic attraction | Can print on rough surfaces, simple implementation | Requires high voltage power supply |
| 2. AC electric field | Higher field strength is possible than electrostatic, operating margins can be increased, ink pressure reduced, and dust accumulation is reduced | Requires high voltage AC power supply synchronized. to drop ejection phase. Multiple drop phase operation is difficuit |
| 3. Proximity (printhead in close proximity to, but not touching, recording medium) | Very small spot sizes can be achieved. Very low power dissipation. High drop position accuracy | Requires print maximum to be very close to printhead surface, not suitable for rough print media, usually requires transfer roller or |
| 4. Transfer Proximity (print-head is in close proximity to a transfer roller or belt | Very small spot sizes can be achieved, very low power dissipation, high accuracy, can print on rough paper | Not compact due to size of transfer roller or transfer belt. |
| 5. Proximity with oscillating ink pressure | Useful for hot melt inks using viscosity reduction drop selection method, reduces possibility of nozzle clogging, can use pigments instead of dyes | Requires print medium to be very close to printhead surface, not suitable for rough print media. Requires ink pressure oscillation apparatus |
| 6. Magnetic attraction | Can print on rough. surfaces. Low power if permanent magnets are used | Requires uniform high magnetic field strength, requires magnetic ink |

Silverbrook discloses a liquid printing system that affords significant improvements toward overcoming the prior art problems associated with drop size and placement accuracy, attainable printing speeds, power usage, durability, thermal stresses, other printer performance characteristics, manufacturability, and characteristics of useful inks. Silverbrook discloses a single microscopic nozzle tip having pressurized ink extending from the nozzle, which is formed from silicon dioxide layers with a heater and a nozzle tip. The nozzle tip is passivated with silicon nitride. The "Silverbrook" technique provides for low power consumption, high speed, and page-wide printing. In such ink jet printheads, the energy barrier for ejecting an ink droplet is reduced by reducing the surface tension of the ink solution. The ink solution in an ink reservoir is under a static pressure so that an ink meniscus is bulged outward at a nozzle outlet. For each selected nozzle, a voltage pulse is applied to a ring-shaped resistor. The heating of the resistor by the electric pulse reduces the surface tension of the ink solution in the vicinity of the rim of the nozzle. The heated ink solution is pushed outward by the static pressure. The interplay between the surface tension reduction by heating and the static pressure begins to dominate, and finally ejects the ink droplet to a receiver media. The separation of the droplet from the nozzle can be assisted by a static electric field applied that attracts the ink droplet toward the receiving media.

In other words, such an ink jet printer as described immediately hereinabove includes a multiplicity of nozzles having orifices opening toward the recorder medium. An ink droplet in each nozzle is under a predetermined static back-pressure in order to propel the ink droplet onto the recorder medium. However, before the ink droplet is propelled toward the recorder medium, it is initially restrained or held in the orifice by surface tension even though the ink droplet is under static back-pressure. This results in an ink meniscus bulging outwardly at the nozzle orifice without leaving the orifice. This is so because, by design, the back-pressure is initially insufficient to overcome the ink droplet's surface tension. Therefore, in order to print on the recorder medium, the surface tension of the ink droplet is decreased, so that the ink droplet is released from the nozzle orifice and propelled onto the recorder medium by the previously mentioned back-pressure. To decrease surface tension, a voltage pulse is applied to an electrical resistance heater that is located inside the nozzle and that is therefore in heat transfer communication with the ink droplet. Heating of the resistance heater by the voltage pulse heats the ink droplet, thereby reducing the surface tension of the ink droplet. Of course, the static back-pressure acting on the ink droplet coacts with the simultaneous decrease in surface tension to eject the ink droplet from the orifice and propel it onto the recorder medium.

However, ink jet printers may produce non-uniform print density with respect to the image deposited on the recorder medium. Such non-uniform print density may be visible as so-called "banding". "Banding" is evinced, for example, by repeated variations in the print density caused by delineations in individual dot rows comprising the output image. Thus, "banding" can appear as light or dark streaks or lines within a printed area. "Banding" is influenced by factors such as ink drop volume variations, print head carriage motion anomalies, electrical resistance variation of the heaters, and/or the presence of damaged nozzles.

One important factor producing "banding" is variability in the nozzle orifice diameter caused by variations in the manufacturing process used to make the nozzles constituting the print head. Even small variations between nozzles of a print head may lead to visible "banding". More specifically, when the ink droplet is pushed outwardly during ejection from the nozzle, the moving ink droplet must overcome flow resistance caused by the nozzle's flow channel and also flow resistance caused by the nozzle's orifice. Therefore, the ejection speed of the droplet is strongly dependent on the flow resistance or drag force exerted by the nozzle's flow channel and the nozzle's orifice. Nozzle diameter affects flow resistance or drag force and therefore affects the amount of ink ejected from the nozzles. Moreover, nozzle diameter also affects the meniscus shape of the ink at the nozzle's orifice, which in turn affects droplet volume and ejection rate. In addition, heater electrical resistance can vary among nozzles due to slight variations in the composition of the material comprising the electric resistance heaters disposed in the nozzles. Variations in electrical resistance among nozzles causes variations in the amount and ejection speed of the ink thereby leading to variations in print density. All the afore mentioned factors negatively affect print density and invite "banding". Therefore, a problem in the art is non-uniform print density due to the presence of physical variations among the print nozzles, such as variations in nozzle diameter and electrical resistance.

Techniques specifically addressing the problem of non-uniform print density are known. One such technique is disclosed in U.S. Pat. No. 5,038,208 titled "Image Forming Apparatus With A Function For Correcting Recording Density Unevenness" issued Aug. 6, 1991 in the name of Hiroyuki Ichikawa This patent discloses memory means for storing data corresponding to image forming characteristics (i.e., print density) of each nozzle of multi-nozzle print heads, and a corrector means for correcting the image forming signals based on the data stored in the memory means. However, this patent does not appear to disclose an efficient and cost effective solution to the problem of non-uniform print density or "banding". For example, the Ichikawa patent discloses that image processing is required for correcting density non-uniformities for each input image file. That is, image processing is required for each and every input image for which output density correction is desired. Correcting density non-uniformities for each input image file is undesirable because it is time consuming. Also, this patent discloses that modulation in the output code value is made at a relatively limited number of discrete levels for halftoned images at a typical printing resolution (i.e., 600 dots per inch). However, printing at discrete levels may not eliminate visual printing defects, such as "banding".

Therefore, what has long been needed is a suitable imaging apparatus and method for providing images of uniform print density, so that printing non-uniformities, such banding, are avoided.

DISCLOSURE OF THE INVENTION

The invention in its broad form resides in an imaging apparatus, comprising a plurality of nozzles, each of the nozzles having an image forming characteristic associated therewith, each of the nozzles adapted to receive a voltage pulse capable of altering the image forming characteristic and a controller connected to the nozzles for controlling the voltage pulse received by the nozzles, so that the altered image forming characteristics for all of said nozzles are uniform.

An object of the present invention is to provide a suitable imaging apparatus and method for providing images of uniform print density produced by print nozzles, so that printing non-uniformities, such as banding, are avoided, even when the print nozzles have different physical attributes resulting in different printing characteristics.

A feature of the present invention is the provision of a controller connected to the heater elements for controlling the heater elements disposed in the nozzles, so that the nozzles print with uniform print density.

Another feature of the present invention is the provision of a memory unit connected to the controller for storing print density as a function of voltage pulse amplitude for each nozzle, the memory unit capable of informing the controller of the pulse amplitude required for obtaining a desired print density.

Still another feature of the present invention is the provision of a memory unit connected to the controller for storing the print density as a function of voltage pulse duration for each nozzle, the memory unit capable of informing the controller of the pulse duration required for obtaining a desired print density.

An advantage of the present invention is that images of uniform print density are provided even in the presence of variations in such factors as electrical resistance of the heater and/or diameter of the nozzle orifice.

Another advantage of the present invention is that images of uniform print density are produced in a more time efficient manner compared to prior art techniques.

A further advantage of the present invention is that use thereof eliminates visual printing defects, such as "banding".

These and other objects, features and advantages of the present invention will become apparent to those skilled in the art upon a reading of the following detailed description when taken in conjunction with the drawings wherein there is shown and described illustrative embodiments of the invention.

BRIEF DESCRIPTION OF THE DRAWINGS

In the detailed description of the preferred embodiments of the invention presented hereinbelow, reference is made to the accompanying drawings, in which:

FIG. 14 provides a look-up table showing print density as a function of voltage pulse amplitude supplied to each nozzle;

FIG. 15 provides a look-up table showing print density as a function of voltage pulse duration supplied to each nozzle;

DETAILED DESCRIPTION OF THE INVENTION

Figure 1:
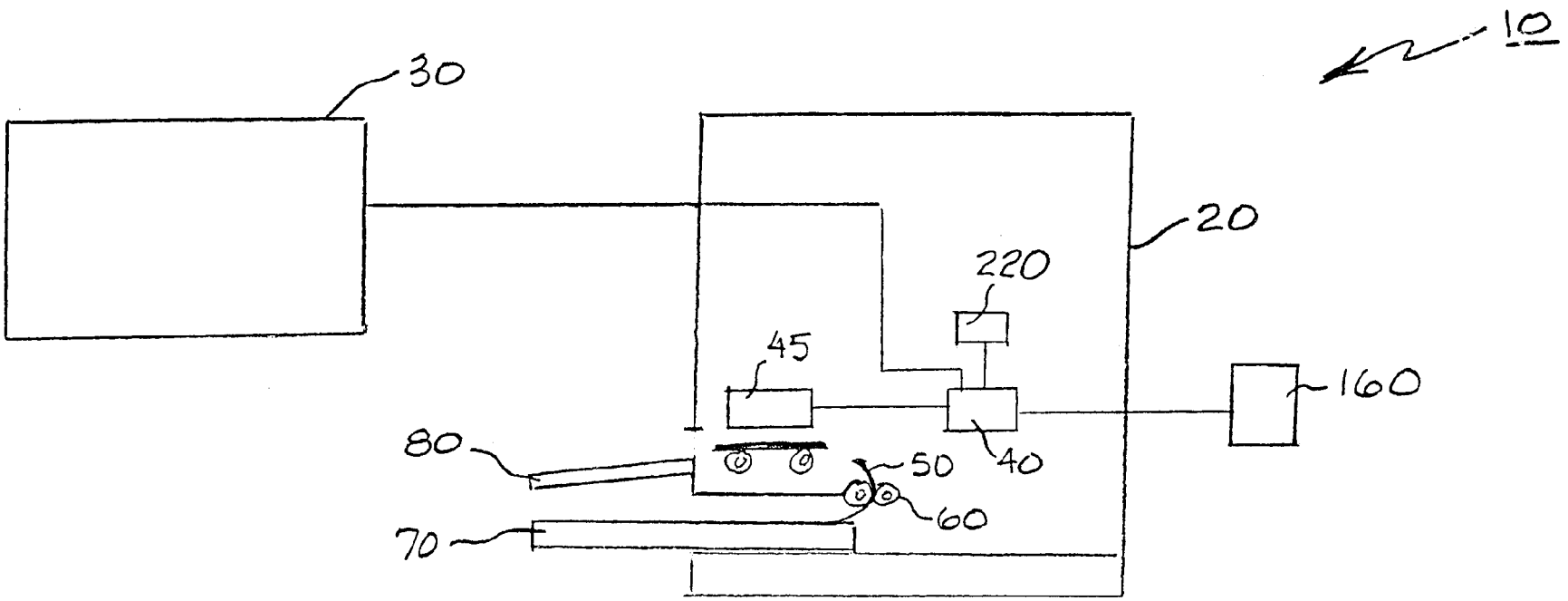
FIG. 1 is a view in partial vertical section, with parts removed for clarity, of the imaging apparatus showing an ink-jet print head printing an image onto a recorder medium, this view also showing a controller connected to the print head for controlling image forming characteristics associated with the print head.

Referring to FIG. 1, there is shown an imaging apparatus, generally referred to as 10, having a uniform image forming characteristic for producing an output image lacking printing defects such as "banding". In the preferred embodiment of the invention, the image forming characteristic is print density. Imaging apparatus 10 comprises a printer, generally referred to as 20, electrically connected to an input source 30 for reasons disclosed hereinbelow. Input source 30 may provide raster image data from a scanner or computer, outline image data in the form of a page description language, or other form of digital image data. The output signal generated by input source 30 is received by a controller 40, for reasons disclosed in detail hereinbelow.

Figure 2:
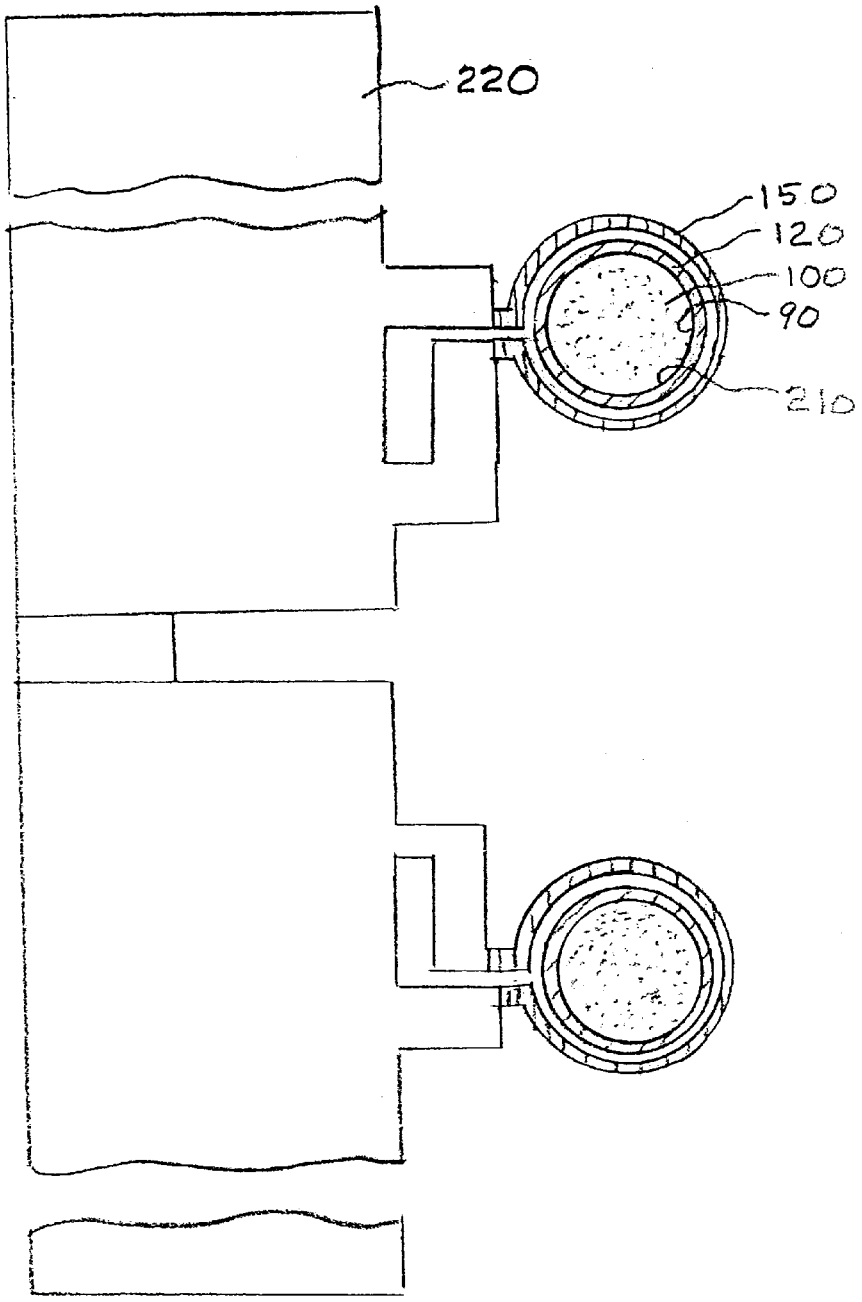
FIG. 2 is a view in horizontal section of a portion of the print head, this view also showing a plurality of nozzles and associated cavities filled with ink, each of the nozzles having an electric resistance heater in heat transfer communication therewith.
Figure 3:
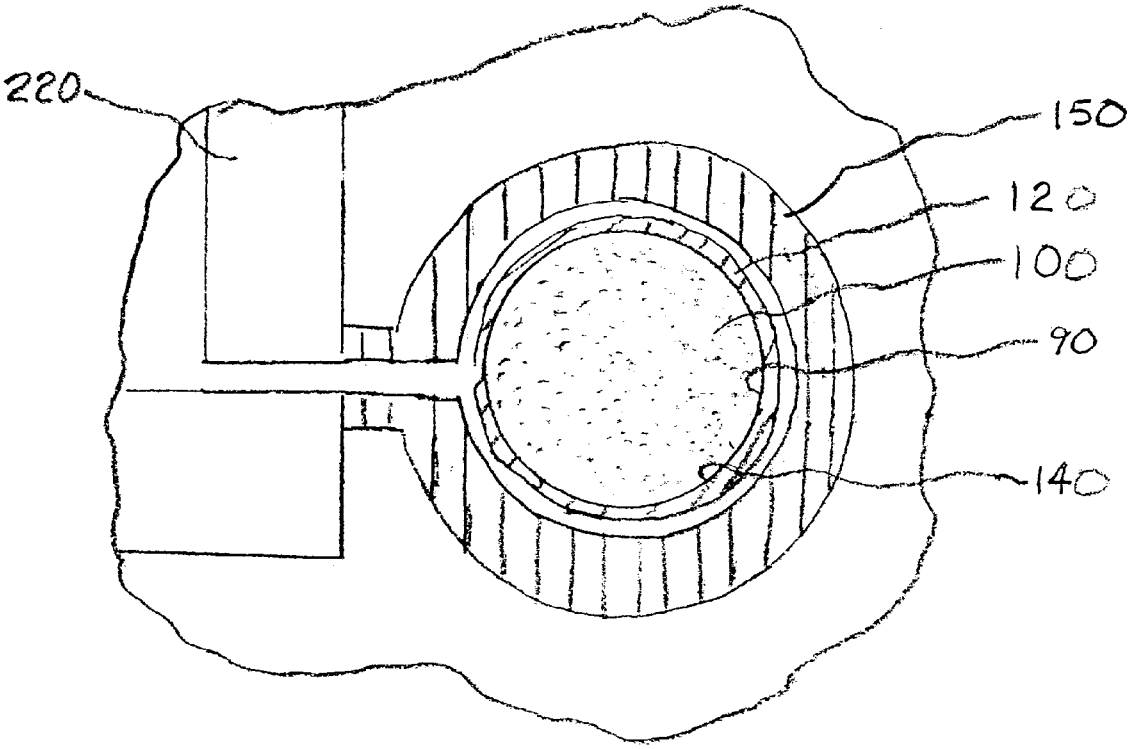
FIG. 3 is a detail view in horizontal section of one of the nozzles.
Figure 4:
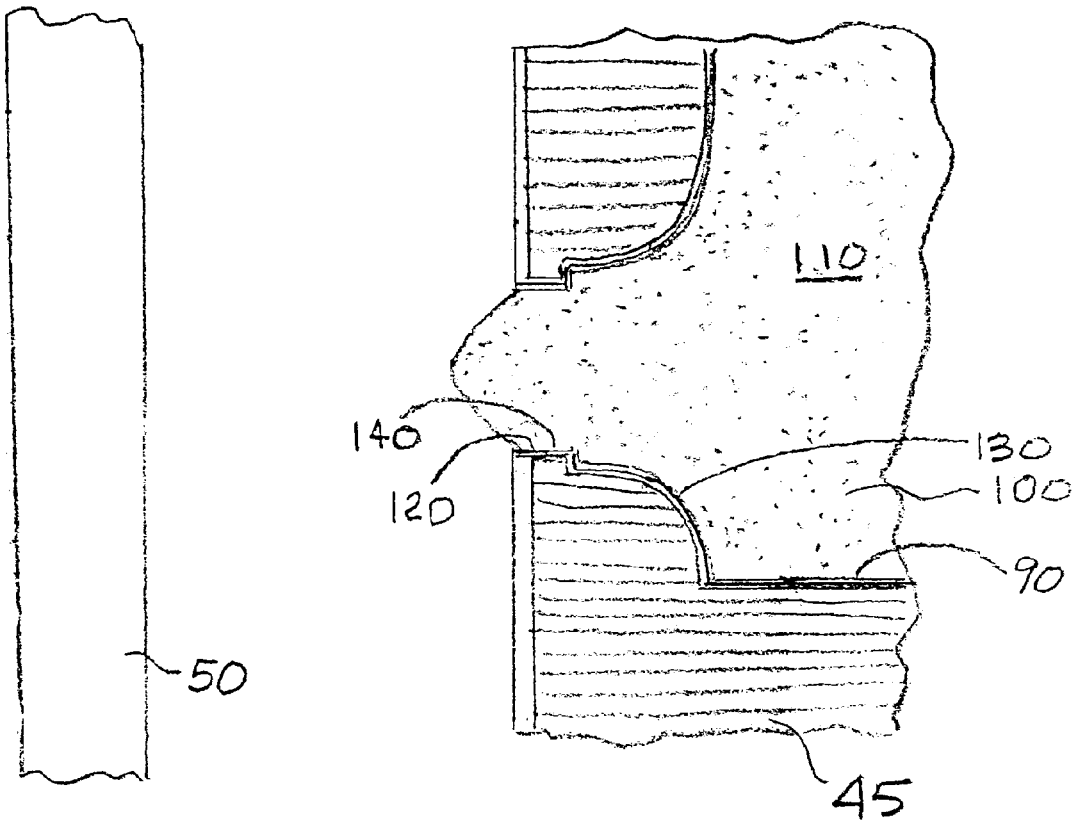
FIG. 4 is a view in vertical section of the nozzle showing the ink being restrained by surface tension from emerging from the nozzle.

Referring to FIGS. 1 and 2, controller 40 processes the output signal generated by input source 30 and generates a controller output signal that is received by a print head 45 capable of printing on a recorder medium 50. In some printers recorder medium 50 may be fed past print head 45 at a predetermined feed rate by a plurality of rollers 60 (only some of which are shown). That is, recorder medium 50 may fed, by rollers 60, from an input supply tray 70 containing a supply of recorder medium 50. Each line of image information from input source 30 is printed on recorder medium 50 as that line of image information is communicated from input source 30 to controller 40. Controller 40 in turn communicates that line of image information to print head 45 as recorder medium 50 is fed past print head 45. When a completely printed image is formed on recorder medium 50, recorder medium 50 exits the interior of printer 20 to be deposited in an output tray 80 for retrieval by an operator of imaging apparatus 10. Although the terminology referring to "print head 45" is used in the singular, it is appreciated by the person of ordinary skill in the art that the terminology "print head 45" is intended to also include its plural form because there may be, for example, four print heads 110, each one of the print heads 110 being respectively dedicated to printing one of four colors (i.e., red, green, blue and black).

Turning now to FIGS. 1, 2, 3, and 4, print head 45, which belongs to printer 20, is there shown in operative condition for printing an image on recorder medium 50. Print head 45 comprises a plurality of ink fluid cavities 90 for holding print fluid, such as a body of ink 100. Each cavity 90 is in communication with a print fluid reservoir 110 for supplying ink 100 into cavity 90. Moreover, associated with each cavity 90 is a nozzle 120 for allowing ink 100 to exit cavity 90. In this regard, each nozzle 120 includes a flow channel 130 and a generally circular orifice portion 140 in communication with flow channel 130. Orifice portion 140, which is disposed proximate recorder medium 50, opens toward recorder medium 50 for depositing ink 100 onto recorder medium 50. Moreover, lining orifice portion 140 and flow channel 130 is a generally annular electrothermal actuator (i.e., an electrical resistance heater element) 150 for heating ink 100, heater 150 having a predetermined electrical resistance. Thus, each heater 150 is in heat transfer communication with ink 100. A voltage supply unit 160 is electrically connected to print head 45 for supplying a voltage pulse to each heater 150. Each nozzle 120 has an image forming characteristic (e.g., print density) associated therewith. As described more fully hereinbelow, the voltage pulse is capable of altering the image forming characteristic to define an altered image forming characteristic. Controller 40 controls the voltage pulse so that the altered image forming characteristics for all nozzles 120 are uniform.

Figure 5:
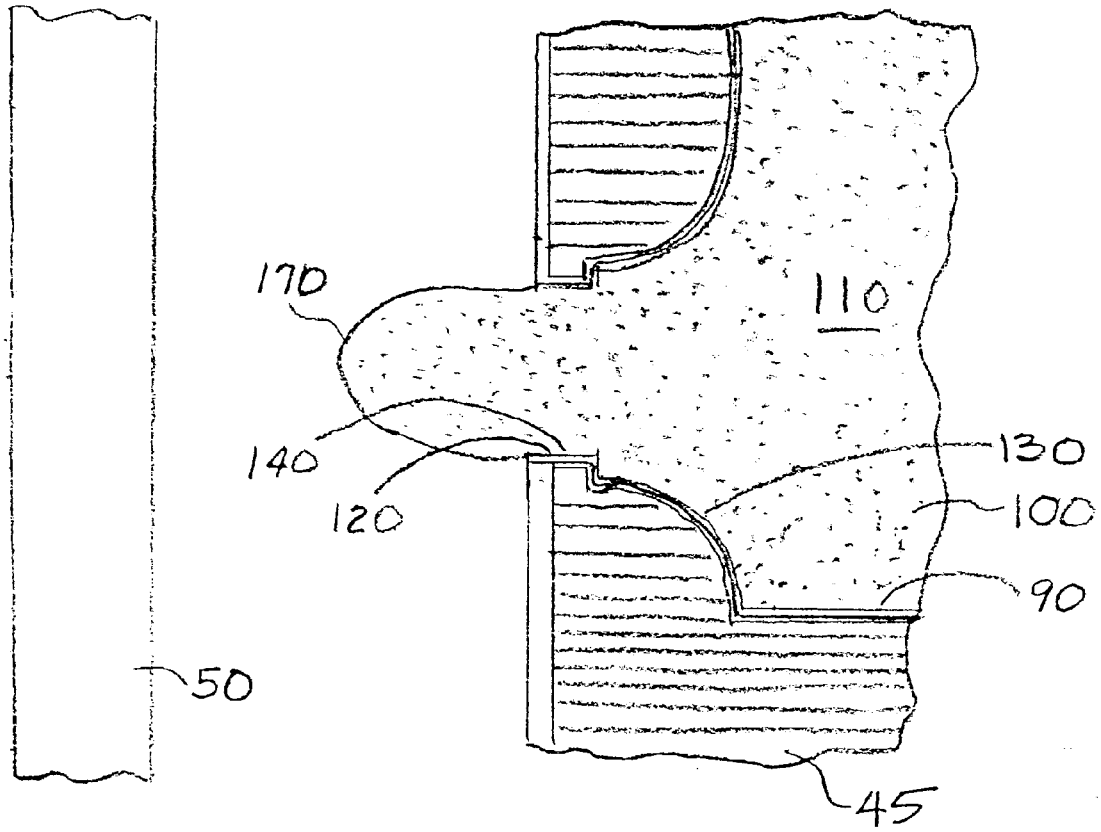
FIG. 5 is a view in vertical section of the nozzle showing an ink droplet emerging from the nozzle as the surface tension begins to relax.
Figure 6:
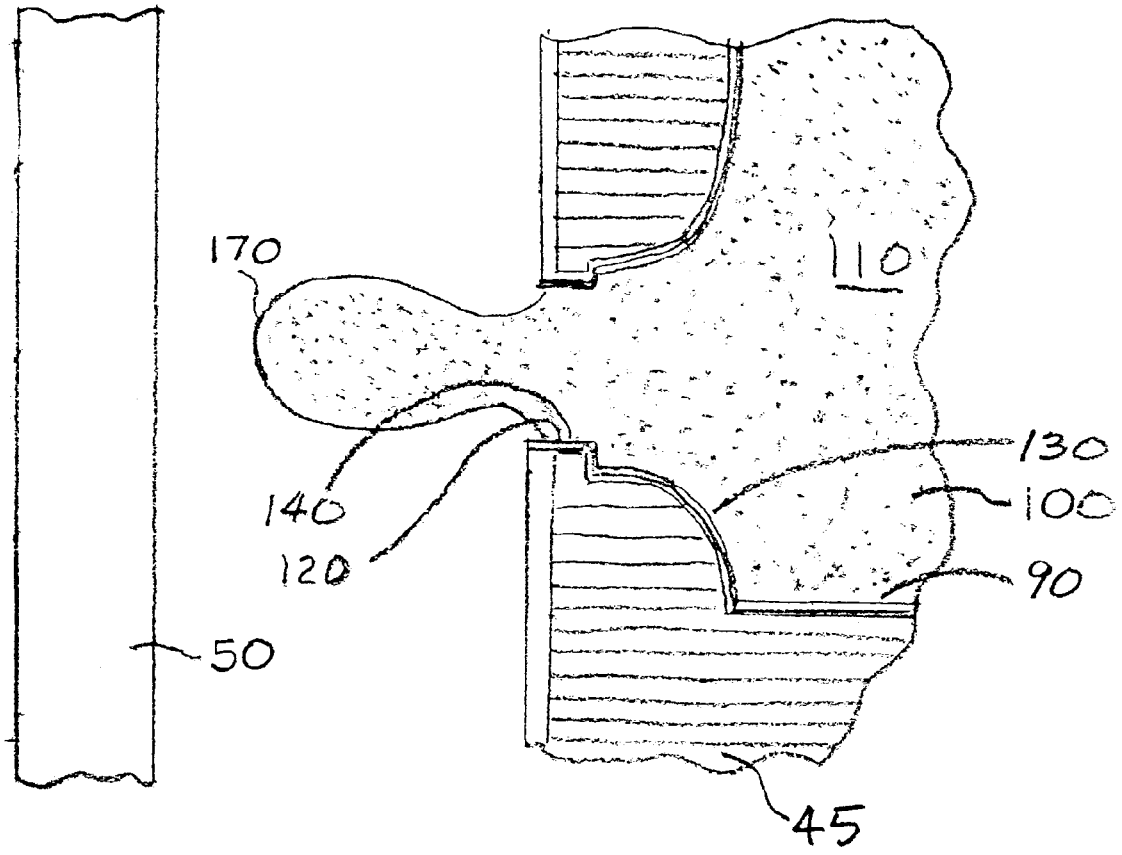
FIG. 6 is a view in vertical section of the nozzle showing the ink droplet emerging further from the nozzle as the surface tension further relaxes.

As best seen in FIGS. 5 and 6, an ink bulge, meniscus or droplet 170 outwardly emerges from orifice region 140 as resistance heater 150 increases temperature in order to heat ink 100. This heating of ink 100 results in a localized decrease in surface tension of droplet 170. As the surface tension of droplet 170 decreases, it assumes a substantially cylindrical form due to a surface tension gradient from the tip of orifice region 140 to the center of droplet 170, and due to viscous drag or flow resistance along the surface of flow channel 130 and orifice region 140.

Figure 7:
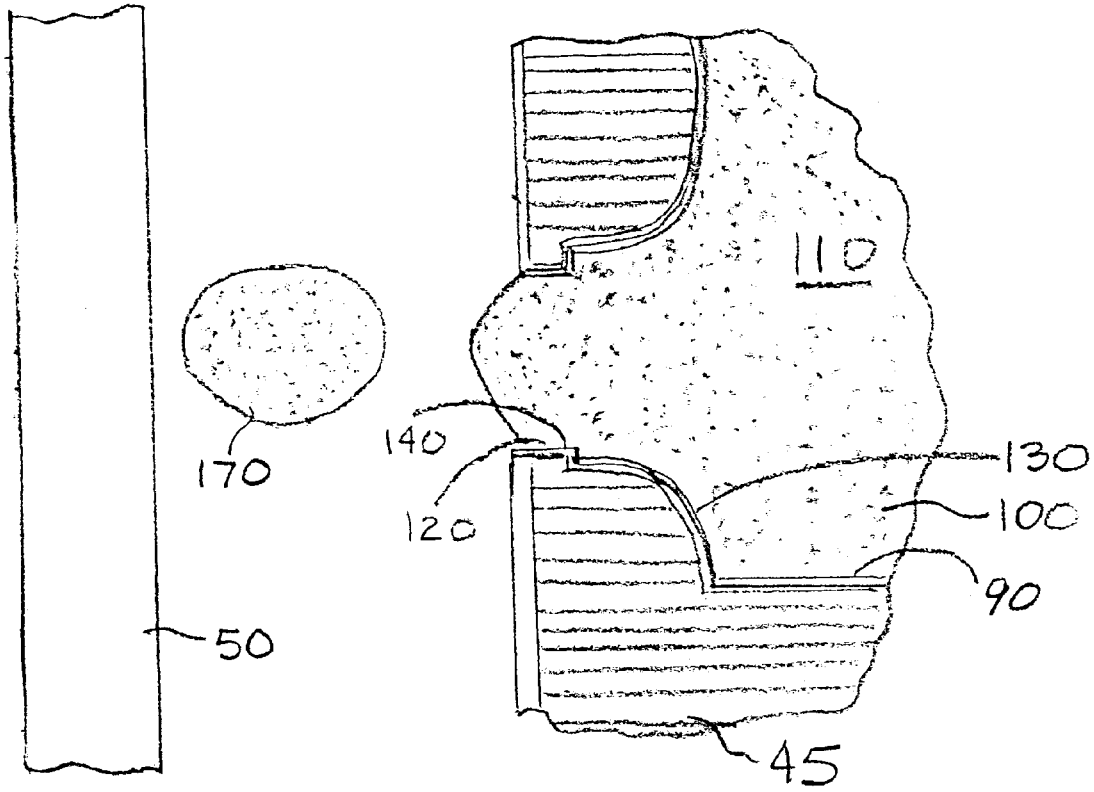
FIG. 7 is a view in vertical section of the nozzle showing the ink droplet having emerged from the nozzle and propelled toward the recorder medium by back-pressure.

FIG. 7 shows droplet 170 separated from ink body 100 and ejected from orifice region 140 as it is propelled outwardly toward recorder medium 50 to establish an ink mark upon recorder medium 50. In this regard, it is appreciated by the person of ordinary skill in the art that gravity does not significantly affect the trajectory of droplet 170 because gravity is not significant on this scale. Droplet 170 will eventually be intercepted by recorder medium 50 to "soak into" and be absorbed by recorder medium 50. Moreover, each resistance heater 150 may be selectively energized many times by voltage supply unit 160 to deposit a multiplicity of ink marks upon recorder medium 50 in a predetermined pattern according to the image file residing in input source 30. Of course, the image printed onto recorder medium 50 should possess a uniform print density to avoid "banding".

However, it is known that "banding" is a recurring problem in the printing arts. Often "banding" (i.e., print density non-uniformity) results from variability in the print head fabrication process. For example, banding can be caused by variability in the diameter of orifice region 140 due to variations in the manufacturing process used to make nozzle 120 or by variability in electrical resistance among resistance heaters 150 due to slight variations in the chemical composition comprising heaters 150. Even small variations in diameter and electrical resistance can lead to visible "banding". Therefore, a long-standing problem experienced in the art is banding, which is caused by the presence of physical variations among individual print nozzles 120.

To solve this problem, the present invention controls the voltage pulse amplitude or, alternatively, the voltage pulse duration supplied to each heater 150 to compensate for physical anomalies (e.g., variations in the diameter of orifice region 140, and/or variations in electrical resistance of heaters 150) associated with individual nozzles 120. Controlling the voltage pulse in this manner obtains uniform print density on recorder medium 150. This result is attainable because controlling the voltage pulse amplitude and/or voltage pulse duration supplied to each nozzle 120 controls the surface tension of ink droplet 170, which in turn controls the rate and the volume of ink released from each nozzle 120. Controlling the release of ink from each nozzle 120 controls the print density provided by each nozzle 120. As described more fully hereinbelow, nozzles 120 are calibrated, such that each nozzle 120 will selectively receive a predetermined pulse voltage amplitude or pulse voltage duration as print head 45 is operated in order that print densities for all nozzles 120 are substantially the same (i.e., uniform), even though physical attributes among nozzles 120 may vary. However, to fully appreciate the present invention, it is instructive first to briefly discuss the relationship between print density, voltage pulse amplitude, voltage pulse duration, and heater resistance.

Therefore, according to the present invention, the volume of ink 100 ejected by print head 45 is a function of the amplitude and duration of the voltage pulse supplied to print head 45. Larger droplets 170 with larger volumes of ink will cause higher density images on recorder medium 50. Conversely, smaller droplets 170 with smaller volumes of ink will cause lower density images on recorder medium 50. Thus, print density is a function of the amplitude and the duration of the electric pulse received by print head 45 because the volume of ink released is a function of the amplitude and duration of the voltage pulse. In other words, the dependence of print density of print head 45, as a whole, on voltage amplitude and voltage duration can be expressed by the following functional relationship:

$$D=f(V_p, T) \qquad \text{Equation (1)}$$

where,

D=print density of print head 45;

$V_p$=voltage pulse amplitude supplied to print head 45; and

T=voltage pulse duration supplied to print head 45.

Figure 8:
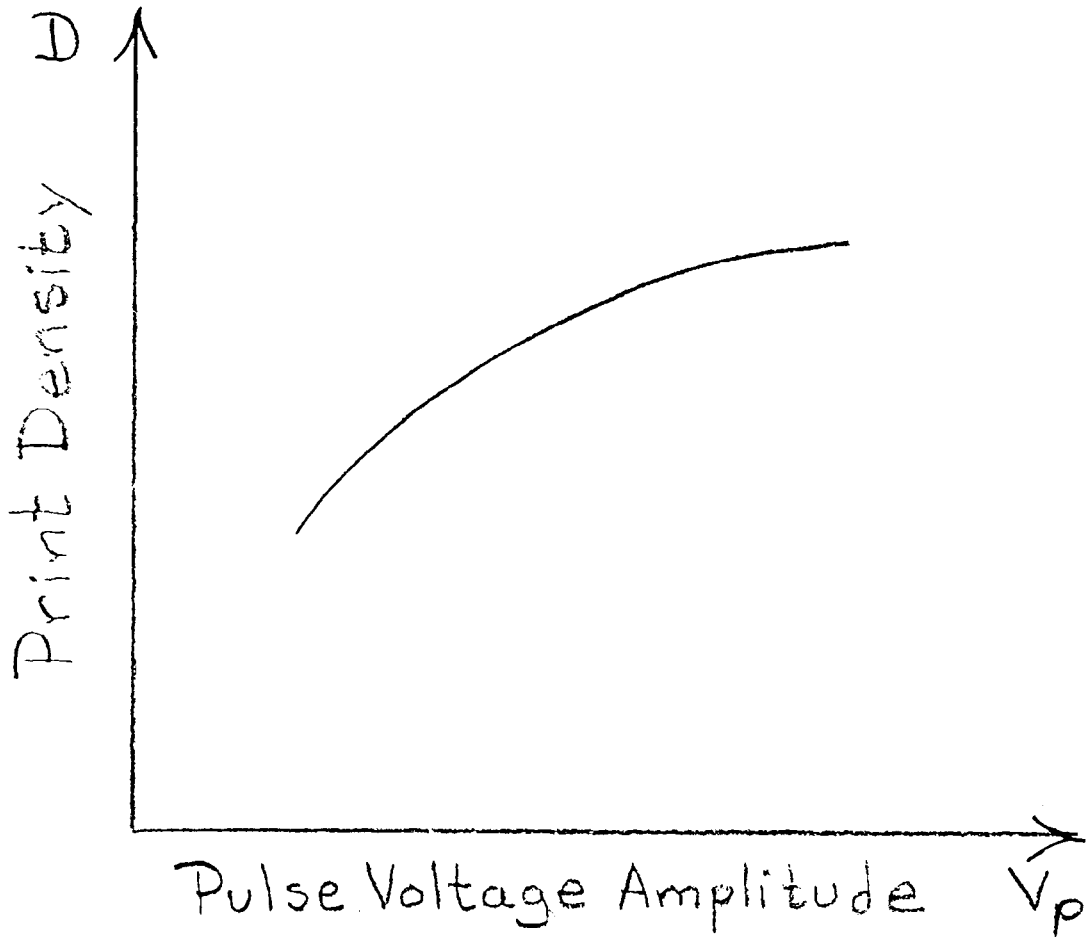
FIG. 8 is a graph illustrating print density as a function of pulse voltage amplitude.
Figure 9:
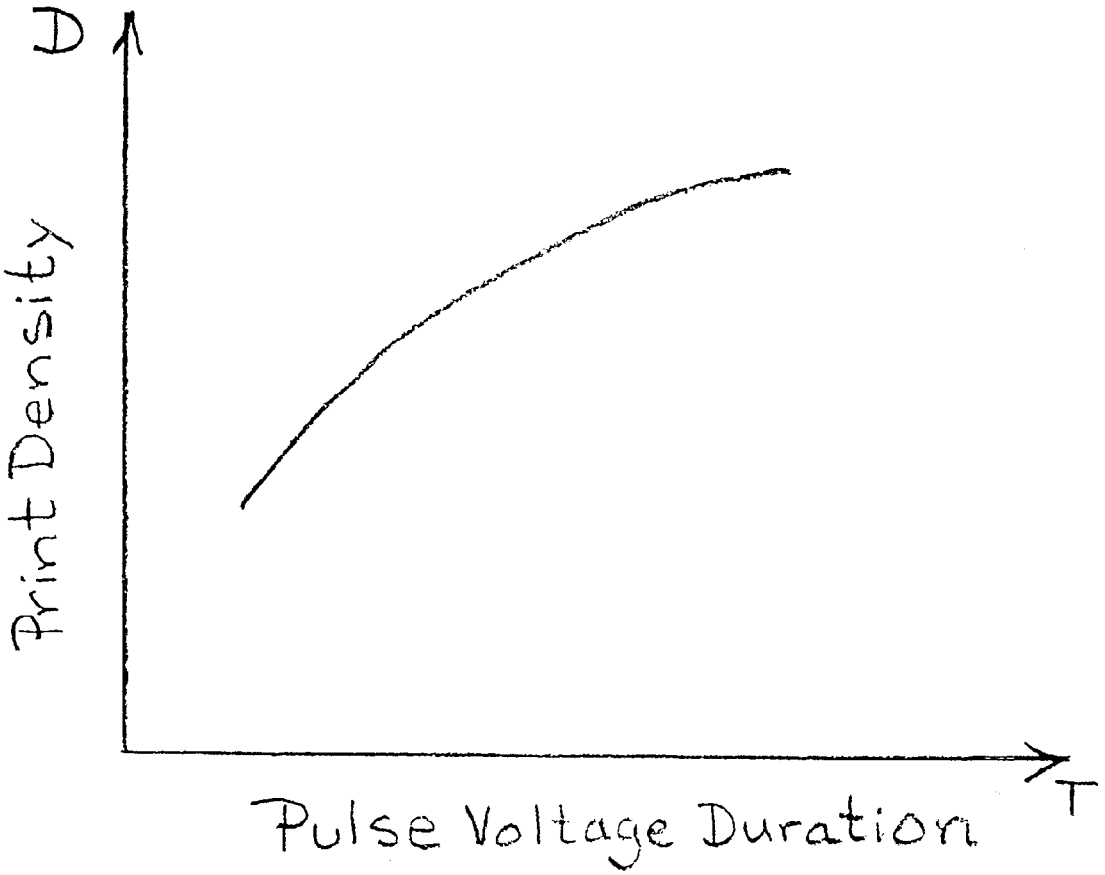
FIG. 9 is a graph illustrating print density as a function of pulse width or duration.

Equation (1) provides print density for print head 45, taken as a whole, and is illustrated graphically for print head 45 in FIGS. 8 and 9. In FIG. 8, print density D is shown as a function of voltage pulse amplitude $V_p$ while holding the voltage pulse duration T constant. In FIG. 9, print density D is shown as a function of voltage pulse duration T while holding the voltage pulse amplitude $V_p$ constant. The precise functional dependence of print density D upon voltage pulse amplitude $V_p$ and voltage pulse duration T as illustrated by FIGS. 8 and 9, respectively, is obtainable by measuring print density D of a uniform test image printed by the relatively large number of nozzles 120 of print head 45, as described more fully hereinbelow.

Figure 10:
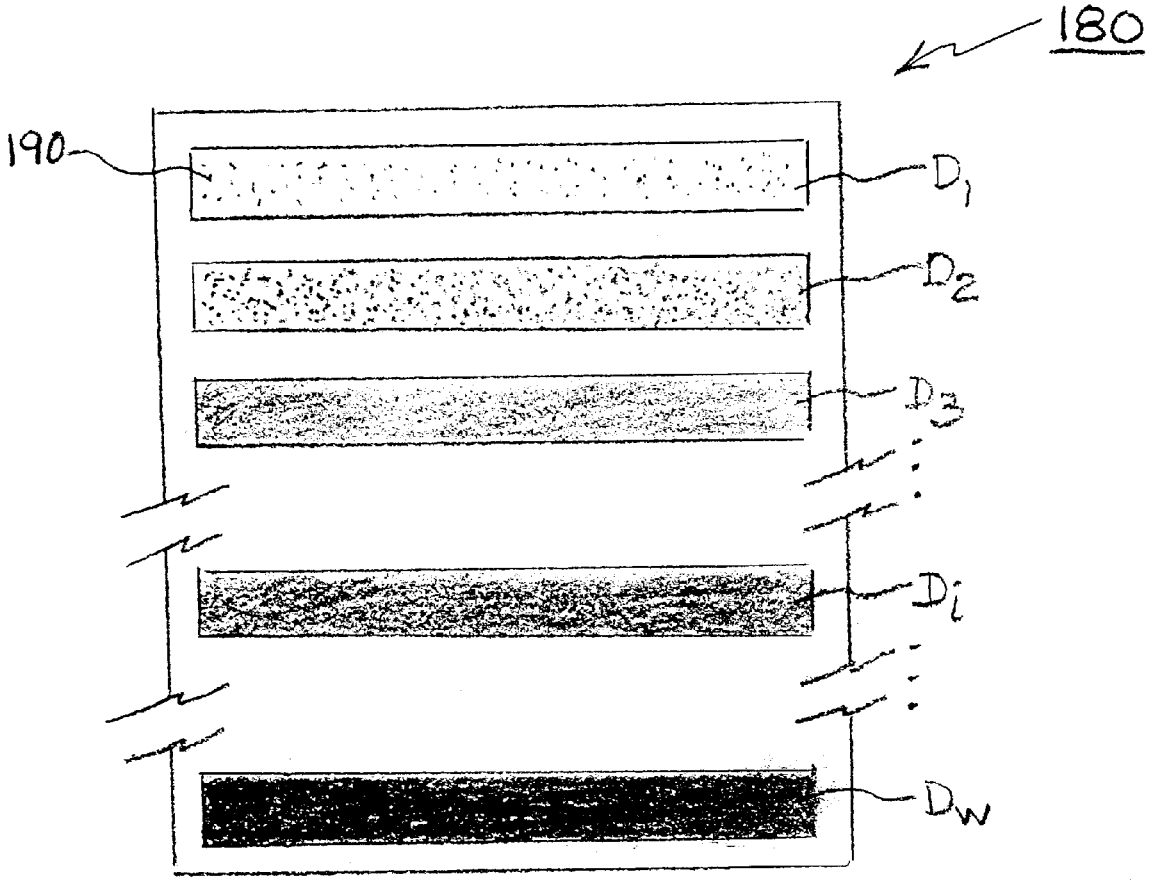
FIG. 10 shows a test image printed on recorder medium for a density uniformity calibration of the print head nozzles.

Therefore, referring to FIG. 10, there is shown a representative test image 180 used for calibrating nozzles 120, so that nozzles 120 will print with uniform print density regardless of physical anomalies among individual nozzles 120. Test image 180 includes a plurality of "density patches" 190 having print densities D varying from a minimum print density $D_1$ (i.e., near white or light halftone) to a maximum print density $D_W$. The print densities D for each of the density patches 190 is preferably measured by use of a densitometer (not shown) which scans a generally circular print area (e.g., approximately 0.20 square centimeters) of each density patch 190. Preferably, the densitometer is used to scan many different areas of each density patch 190. These multiple densitometer readings are averaged to provide an averaged density value for each density patch 190. A separate test image 180 is produced at each of a plurality of voltage pulse amplitudes while keeping the voltage pulse duration constant. Also, a separate test image 180 is produced at each of a plurality of voltage pulse durations while keeping the voltage pulse amplitude constant. This process results in a multiplicity of print density measurements because measurement of print density using the densitometer is repeated for each density patch 190 of each test image 180. Moreover, the foregoing process is repeated for each of the print heads 110 (e.g., for each of the print heads corresponding to each of the colors red, green, blue and black).

Figure 11:
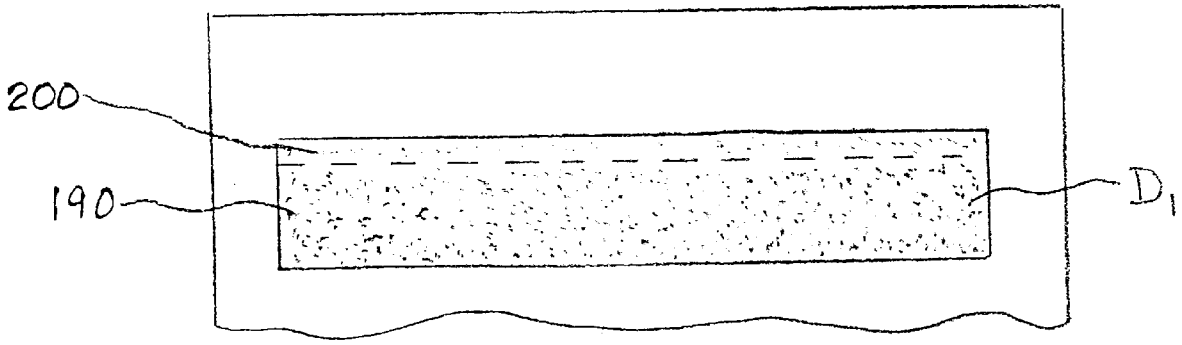
FIG. 11 shows a density patch belonging to the test image, this density patch having a marginal area of insufficient print density.

Referring to FIG. 11, more valid densitometer readings are obtained when the densitometer avoids a marginal region 200 of density patch 190. This is so because the print density in marginal region 200 may not be representative of the print density of density patch 190 as a whole. This assumes, of course, that printing is begun in marginal region 200 of density patch 260 and moves vertically downwardly. Such non-representative printing in marginal region 200 may be due, for example, to the halftoning algorithm used to generate test image 180.

With this densitometer data, the precise function shown in Equation (1) for print head 45 is obtained by mathematical means well known in the art, such as by means of statistical curve-fitting procedures. A precise function, which provides print density D as a function of $V_p$, is plotted in FIG. 8. A precise function, which provides print density D as a function of T, is plotted in FIG. 9. However, it should be appreciated that FIGS. 8 and 9 show print density D of print head 45 taken as a whole and does not provide print density of individual nozzles 120. In other words, Equation (1), from which FIGS. 8 and 9 are plotted, provides a functional relationship defining print density for print head 45, as whole. However, as stated hereinabove, print density among nozzles 120 may vary due, for example, to variations in nozzle orifice diameter and/or electrical resistance of heaters 150. It is therefore desirable to calibrate nozzles 120, so that all nozzles 120 of print head 45 print with uniform print density, even though physical attributes among nozzles 120 may vary.

Therefore, according to the present invention, either of two techniques may be used to provide uniform print density of individual nozzles 120 in view of the unique physical attributes associated with each nozzle 120. These two techniques are defined herein as the "Resistance Calibration Technique" and the "Density Calibration Technique" and are described in detail hereinbelow.

Resistance Calibration Technique

The Resistance Calibration Technique may be used to determine the print density D of each nozzle 120 in view of the inherent electrical resistance of each resistance heater element 150 associated with each nozzle 120. Electrical resistance among heater elements 150 may vary due to slight variations in the chemical composition of individual heater elements 150. However, print density D of each nozzle 120 can be controlled by controlling the electric heating pulse applied to each heater element 150 (i.e., to each nozzle 120), even though the electrical resistance among heater elements 150 may vary. As previously mentioned, print density D of print head 45 as a whole is provided by Equation (1); however, it is desirable to determine the print density D for each nozzle 120 within print head 45. In this regard, print density D for each nozzle 120 is provided by an approximation to Equation (1) as follows:

$$D \approx f(E) = f((V_p)^2 T/R) \qquad \text{Equation (2)}$$

where,

E=average heat energy applied to each heater element 150 (i.e., each nozzle 120); and R=electrical resistance inherent in each heater element 150 (i.e., each nozzle 120).

Figure 12:
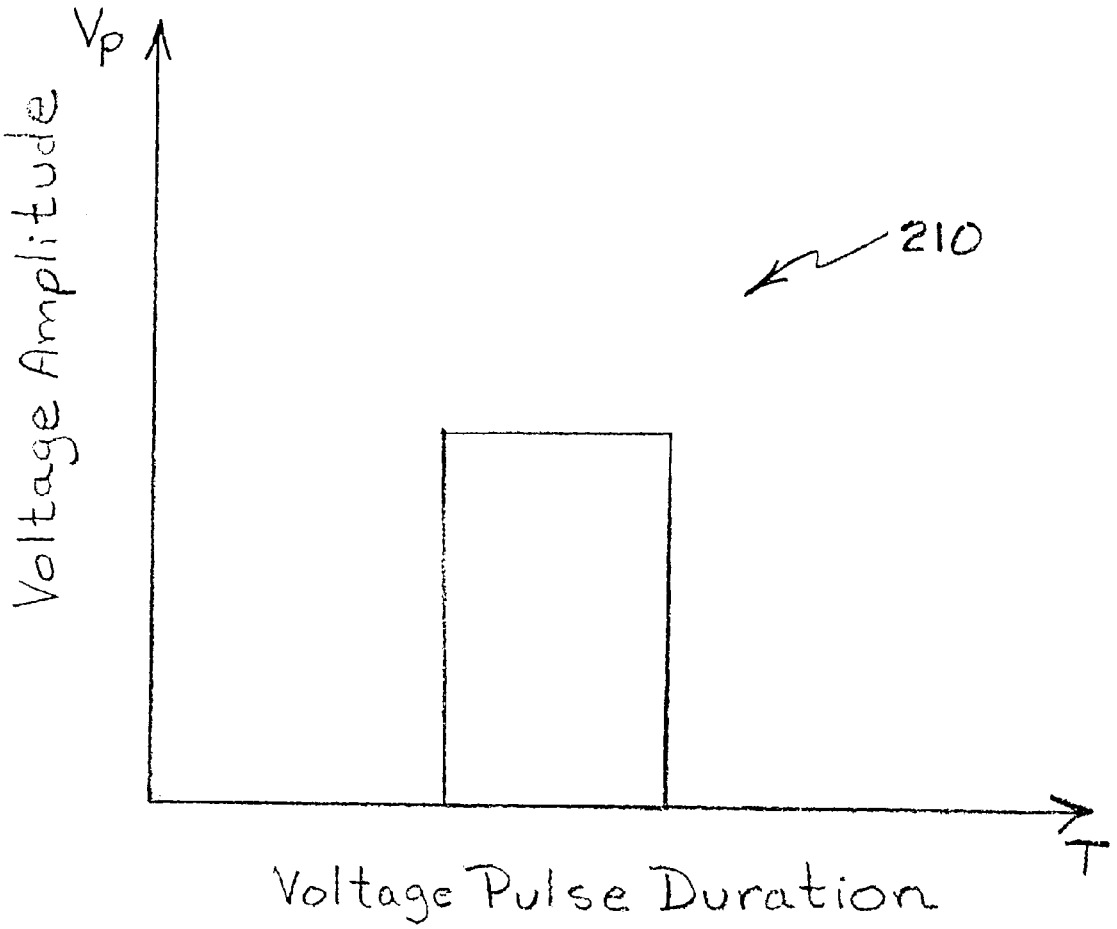
FIG. 12 is a graph illustrating a voltage pulse with a predetermined constant amplitude and a predetermined duration, the voltage pulse being provided to the electric resistance heater in the nozzle for heating the ink in order to relax the surface tension of the ink.
Figure 13:
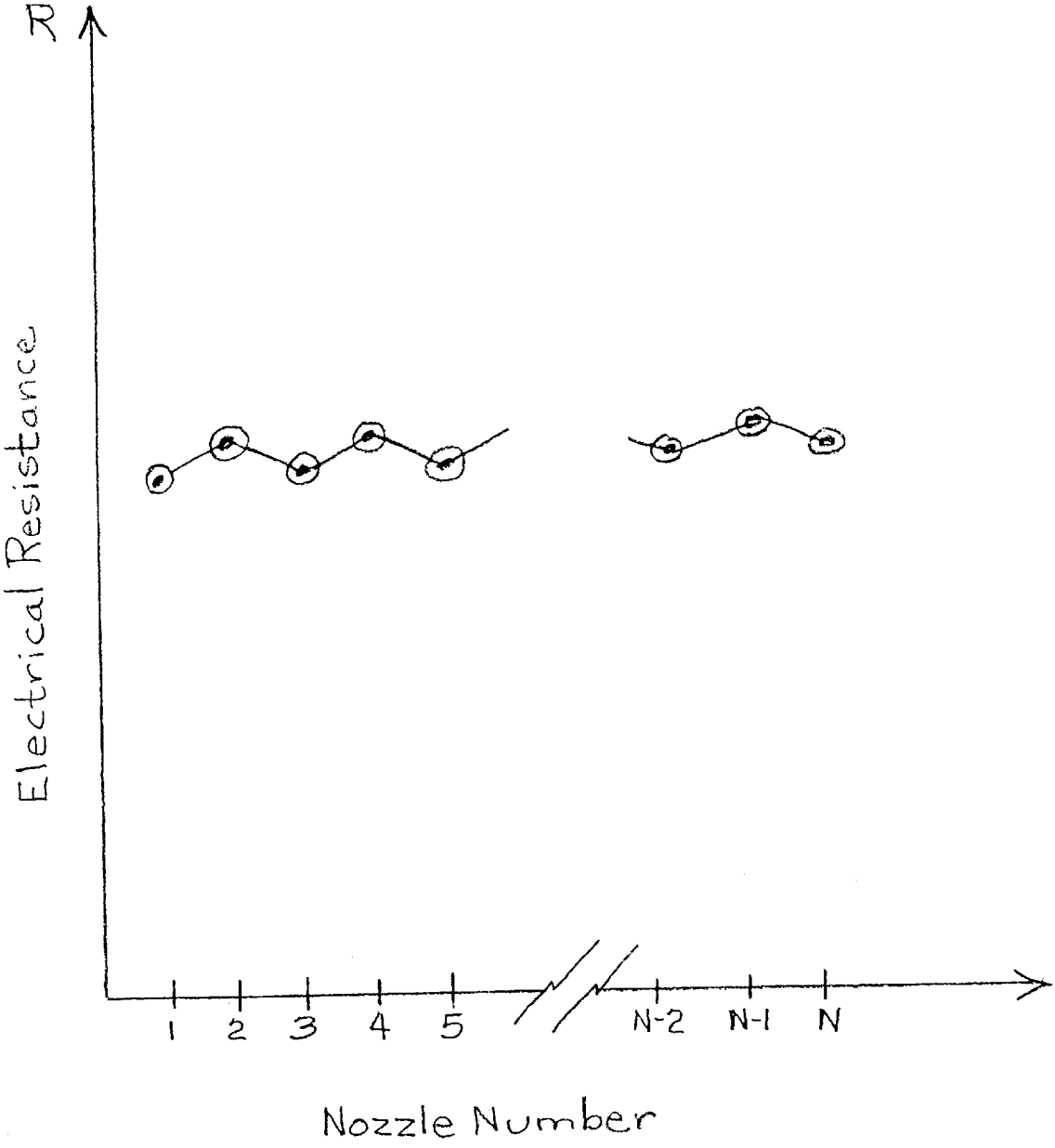
FIG. 13 is a graph illustrating electrical resistance as a function of nozzle number.

Referring to FIGS. 12 and 13, a square wave voltage pulse 210 of constant voltage amplitude $V_{pi}$ is sequentially applied to each heater 150 associated with each nozzle 120. That is, constant voltage pulse 210 is sequentially applied to each heater 150 from the first heater 150 to the last heater 150 in print head 45. The last heater 150 is represented as heater number "N" in FIG. 13. As square wave voltage pulse 210 is input to each heater 150, the output voltage is measured at each heater 150 and a resistance $R_i$ is calculated for each heater 150. Using these calculated values of heater electrical resistances $R_i$, the average resistance R for all heaters 150 in print head 45 is then calculated as follows:

$$\bar{R} = (\Sigma R_i)/N \qquad \text{Equation (3)}$$

where, $\bar{R}$=calculated average electrical resistance of all heaters 150 (i.e., all nozzles 120);

$R_i$=calculated electrical resistance of the "$i^{th}$" heater 150 (i.e., the "$i^{th}$" nozzle 120);

N=total number of heaters 150 (i.e., nozzles 120); and i=1 to N.

In this manner, the average electrical resistance R is calculated. Next, the corrected voltage pulse amplitude $V_{pi}$ or the corrected voltage pulse duration $T_i$ to be applied to each nozzle 110 is calculated. In this regard, Equation (2) can be rewritten as follows:

$$(V_{pi})^2/R_i = (V_p)^2 \bar{R} = E/T \qquad \text{Equation (4)}$$

which, in turn, can be rewritten as $$V_{pi} = (ER_i/T)^{1/2} = V_p(R_i/\bar{R})^{1/2} \qquad \text{Equation (5)}$$

where, $V_{pi}$=voltage pulse amplitude to be applied to the "$i^{th}$" nozzle to obtain the desired heating energy E for each heating voltage pulse.

In other words, $V_{pi}$ is the voltage pulse amplitude to be applied to the "$i^{th}$" nozzle 120 in order for the print density of the "$i^{th}$" nozzle 120 to be equal to the print density D of print head 45. Thus, voltage amplitude $V_{pi}$ for each nozzle 120 is selected such that print density of each nozzle 120 matches the desired print density for print head 45 as a whole. In this manner, nozzles 120 will print with uniform print density because each nozzle 120 will print with the print density D of print head 45.

Alternatively, the voltage pulse duration of the square wave voltage pulse 210 may be used to calibrate each heater 150 in order to provide uniform print density. In this regard, the voltage pulse duration $T_i$ applied to each heater 150 (i.e., each nozzle 110) is calculated by first rearranging Equation (4) as follows:

$$T_i/R_i = T/\bar{R} = E/(V_p)^2 \qquad \text{Equation (6)}$$

where, $T_i$=voltage pulse duration to be applied to the "$i^{th}$" nozzle to obtain the desired heating energy E for each heating voltage pulse.

Equation (6) can be rewritten as follows:

$$T_i = R_i E/V_p)^2 = TR_i/\bar{R}. \qquad \text{Equation (7)}$$

Thus, Equation (5) provides the voltage pulse amplitude $V_{pi}$ or alternatively Equation (7) provides the voltage pulse duration $T_i$ to be applied to each nozzle 110 in order to calibrate each heater 150 (i.e., each nozzle 120) so that all nozzles 120 provide uniform print density even though electrical resistances among heaters 150 may vary. However, it should be recalled that calibration of each heater 150 (i.e., each nozzle 120) using the Resistance Calibration Technique compensates for variabilities only in electrical resistance among individual heaters 150 (i.e., among individual nozzles 120).

Referring to FIGS. 1, 2, 3, 14 and 15, once the pulse voltage amplitudes $V_{pi}$ and/or the pulse voltage durations $T_i$ are obtained by the steps recited hereinabove, these values of $V_{pi}$ and $T_i$ and the print density D of print head 45 are stored electronically in a memory unit, such as a Read-Only-Memory (ROM) semiconductor computer chip 220 connected to controller 40. As best seen in FIGS. 14 and 15, the values of D, $V_{pi}$, and $T_i$ stored in chip 220 are represented herein as first and second look-up tables, generally referred to as 230 and 240, respectively. The values of D, $V_{pi}$, and $T_i$ stored in chip 220 are used as parameters for each nozzle 120 during normal operation of apparatus 10, as described in more detail hereinbelow. More specifically, during normal operation of apparatus 10, the desired print density D is selected, such as by means of input source 30, and is then communicated to controller 40. Once controller 40 accepts density value D to be printed by print head 45, controller 40 is informed by first lookup table 230 in chip 220 as to the correct voltage amplitude $V_{pi}$ to apply to each nozzle 120 in order to obtain uniform print density D from each nozzle 120. In this case, only first look-up table 230 is stored in chip 220. This is so because pulse voltage duration T is held at a constant value by controller 40 and, therefore, there is no need to store second look-up table 240 in chip 220.

Alternatively, once controller 40 accepts a density value D to be printed by print head 45, controller 40 is informed by second lookup table 240 stored in chip 220 as to the correct voltage pulse duration $T_i$ to apply to each nozzle 120 in order to obtain uniform print density D from each nozzle 120. In this case only second look-up table 240 is stored in chip 220. This is so because the pulse voltage amplitude $V_p$ is held at a constant value by controller 40 and, therefore, there is no need to store first look-up table 230 in chip 220.

Although the Resistance Calibration Technique only calibrates heaters 150 to compensate for variabilities in electrical resistance, an advantage of using the Resistance Calibration Technique is its simplicity. That is, each heater 150 (i.e., nozzle 120) belonging to print head 45 is calibrated merely by supplying the square wave voltage pulse 210 illustrated by FIG. 12 and measuring the resulting electrical resistance $R_i$ of each heater 150, as illustrated by FIG. 13. In this manner, each nozzle 120 can be conveniently calibrated during manufacture of print head 45. In addition, each nozzle 120 can be recalibrated, if necessary, "in the field" at a customer site to accommodate print head 45 to the specific environmental conditions (e.g., humidity, dust, temperature, etc.) present at the customer's site. Such environmental conditions may have altered the original calibration of print head 45 performed during manufacture of print head 45.

However, print density depends on other physical characteristics of nozzles 120 in addition to electrical resistance. Therefore, if desired, nozzles 120 may be calibrated to compensate for physical characteristics in addition to electrical resistance. To achieve this result, the present invention provides a technique, defined herein as the Density Calibration Technique, which compensates for variability in substantially all physical characteristics in addition to electrical resistance.

Density Calibration Technique

The Density Calibration Technique calibrates nozzles 120 to compensate for substantially all variabilities among nozzles 120, including variabilities caused by different amounts of electrical resistance, in order to obtain uniform print density. This technique is described in detail hereinbelow.

Figure 16:
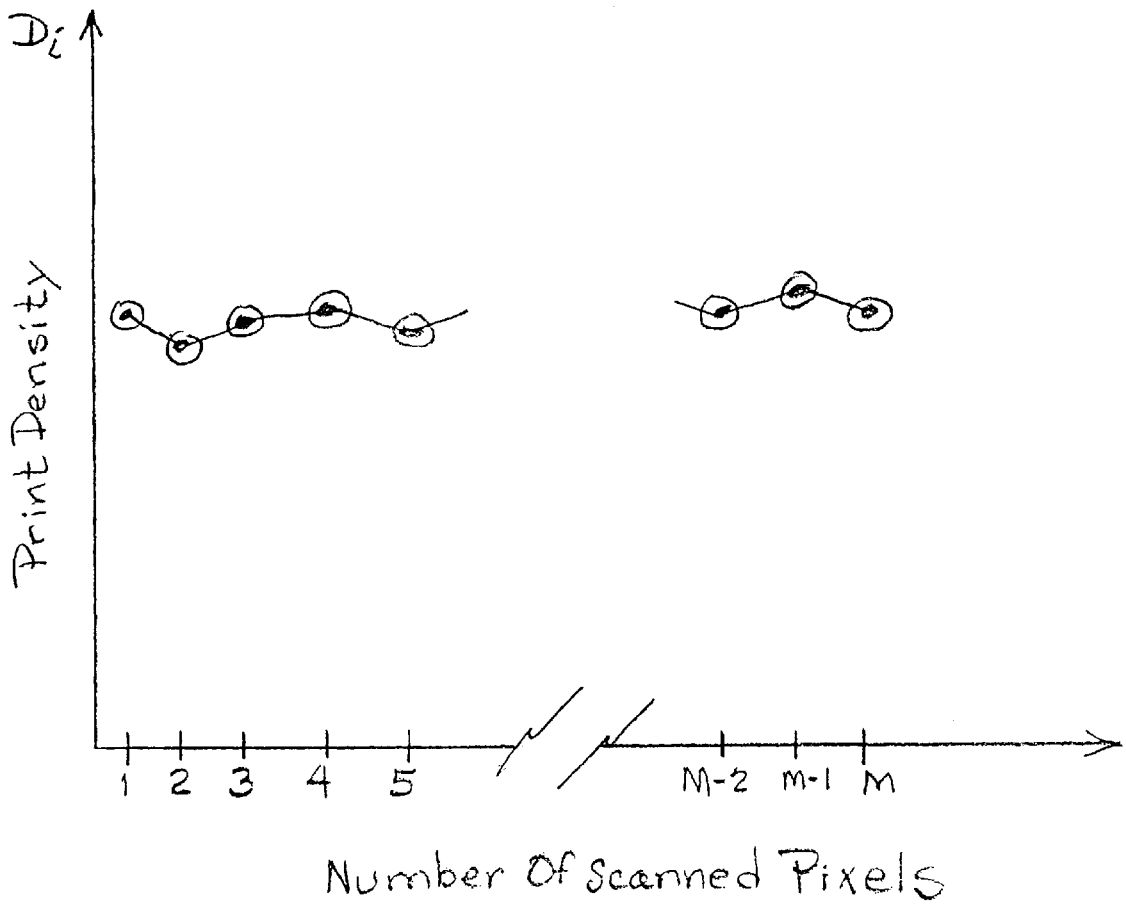
FIG. 16 is a graph illustrating print density as a function of number of scanned pixels of the test image.

Returning to FIGS. 10, 11, 12, 13 and 16, print head 45 to be calibrated is used to print the previously mentioned test image 180 in the manner described hereinabove. This produces print density patches $D_1$ to $D_W$. The previously mentioned densitometer is then used to measure the resulting print densities in two directions (i.e., vertically and horizontally), preferably at a resolution of at least 300 dpi. The density values are integrated vertically down each density patch in order to obtain the one-dimensional density profile of FIG. 16. Thus, FIG. 16 characterizes print density non-uniformity due to physical variabilities among nozzles 120. It is understood that print density measurements are not taken in marginal region 200 for the reasons provided hereinabove. These print density values may be fit, by means well known in the art, to an analytical function so that the print density value for each nozzle 120 is conveniently obtained by reference merely to the analytical function.

After the print densities are obtained, the required voltage pulse amplitude and voltage pulse duration are calculated, as described in detailed hereinbelow. In this regard, print density $D_i$ at the "$i^{th}$" nozzle 120 for a specific density patch 220 is provided by modifying Equation (1) as follows:

$$D_i = f_i(V_{pi}, T) \qquad \text{Equation (8)}$$

where, $D_i$=print density for "$i^{th}$" nozzle 120;

$V_{pi}$=the corrected pulse voltage amplitude for "$i^{th}$" nozzle 120;

T=pulse voltage duration for "$i^{th}$" nozzle 120; and i=1 to total number of nozzles "N".

It is appreciated that Equation (1) and Equation (8) differ to the extent that Equation (8) provides print density $D_i$ considering differences in physical characteristics among nozzles 120 and Equation (1) provides a print density D for print head 45 as a whole irrespective of differences among nozzles 120. In this regard, print head 45 will print with the ideal print density D only if each nozzle 120 prints with this same print density D. However, each nozzle 120 will not necessarily print with the same print density D due to variabilities found, for example, in the diameter of nozzle orifice portion 140 and/or the electrical resistance in heaters 150. Therefore, it remains to determine the print density $D_i$ for each "$i^{th}$" nozzle 120. In this regard, the ideal print density D is obtained by supplying the corrected pulse voltage amplitude $V_{pi}$, at a constant pulse voltage duration T, to each nozzle 120, or alternatively, by supplying the corrected voltage pulse duration $T_i$, at constant pulse amplitude $V_p$, to each nozzle 120.

Thus, for a constant voltage pulse duration T, the print density $D_i$ which is produced by the "$i^{th}$" nozzle 120 is obtained by first noting the following equation:

$$D_i = f_i(V_{pi}, T). \qquad \text{Equation (9)}$$

Subtracting Equation (9) from Equation (1) leads to the following mathematical expression:

$$D - D_i = f(V_p, T) - f_i(V_{pi}, T). \qquad \text{Equation (10)}$$

However, it is understood that the differences among nozzles 120 are assumed to be small so that the derivatives of $f_i$ and $f$ are the same to a first order approximation, as follows:

$$D - D_i = f(V_p, T) - f_i(V_{pi}, T) \approx (\partial f/\partial V_p)\,(V_{pi} - V_p) \qquad \text{Eqn. (11)}$$

where, $\partial f_i/\partial V_p$=partial derivative of the function "fi" with respect to voltage amplitude $V_p$.

When solved for $V_{pi}$, Equation (11) becomes:

$$V_{pi} = V_p + (D - D_i)/(\partial f(V_{pi}, T)/\partial V_{pi}). \qquad \text{Equation (12)}$$

Therefore, Equation (12) provides the voltage pulse amplitude $V_{pi}$ which should be applied to nozzle "i" to obtain a required print density D, which is the print density for print head 45 as a whole. Print density D is selected by the operator of apparatus 10, such as by means of input source 30.

Moreover, using an analogous derivation, the voltage pulse duration $T_i$ which can be applied to nozzle "i" to obtain print density D is found as follows:

$$T_i = T + (D - D_i)/(\partial f(V_p, T)/\partial T). \qquad \text{Equation (13)}$$

As disclosed more fully hereinbelow, the first and second look-up tables 230/240 described hereinabove for the Resistance Calibration Technique are also constructed for the Density Calibration Technique.

Therefore, referring to FIGS. 1, 2, 3, 14 and 15, once the pulse voltage amplitudes $V_{pi}$ and/or the pulse voltage durations $T_i$ are obtained by the steps recited hereinabove for the Density Calibration Technique, these values of $V_{pi}$ and $T_i$ and the corresponding print densities $D_i$ are stored electronically in chip 220, which is connected to controller 40. The values of $D_i$, $V_{pi}$, and $T_i$ stored in chip 220 are used as parameters for each nozzle 120 during normal operation of nozzles 120. That is, the desired print density D is selected, such as by means of input source 30, and is then communicated to controller 40. Once controller 40 accepts a density value D to be printed by print head 45, controller 40 is informed by first lookup table 230 in chip 220 as to the correct voltage amplitude $V_{pi}$ to apply to each nozzle 120 in order to obtain uniform print density D among nozzles 120.

In this case only first look-up table 230, which contains the $V_{pi}$ values as a function of density $D_i$, is stored in chip 220. Also, pulse voltage duration T is held at a constant value by controller 40 and therefore, in this case, there is no need to store second look-up table 240 in chip 220.

Alternatively, once controller 40accepts a density value D to be printed by print head 45, controller 40 is informed by second lookup table 240 stored in chip 220 as to the correct voltage pulse duration $T_i$ to apply to each nozzle 120 in order to obtain uniform print density among nozzles 120. In this case only second look-up table 240, which contains the $T_i$ values as a function of density D*i*, is stored in chip 220. Also, the pulse voltage amplitude $V_p$ is held at a constant value by controller 40 and therefore, in this case, there is no need to store first look-up table 230 in chip 220.

Moreover, efficacy of both the Resistance Calibration Technique and Density Calibration Technique are enhanced when print line times are compatible with the calibration technique selected. "Print line time" is defined herein to mean the time spent on marking each row of ink pixels on recorder medium 180. That is, when voltage pulse amplitude $V_{pi}$ is varied, the voltage pulse duration T is held constant among all nozzles 120 in print head 45 and the printing line time is set equal to or greater than the constant voltage pulse duration T. Alternatively, when voltage pulse duration $T_i$ is varied, the voltage pulse amplitude $V_p$ is held constant among all nozzles 120 in print head 45 and the printing line time is set equal to or greater than the maximum pulse duration allowable for nozzles 120 in the entire print head 45.

Figure 17:
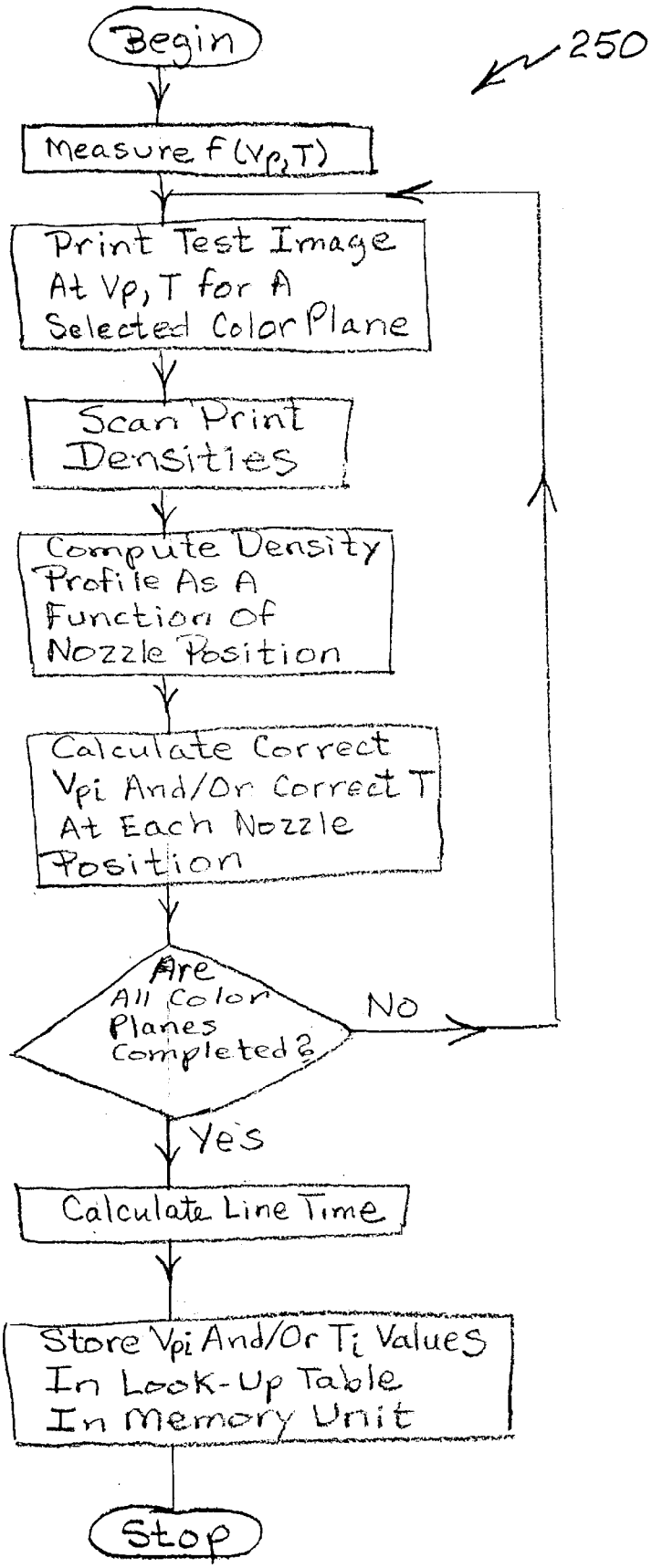
FIG. 17 is a flow-chart illustrating certain steps belonging to the method of the invention.

FIG. 17 presents a flow chart 250 summarizing selected steps in the method of the invention. More specifically, flow chart 250 illustrates steps for arriving at Equations (5), (7), (12) and (13). The steps of the Density Calibration technique described hereinabove calibrates nozzles 120 in such a manner that effectively all physical variations among nozzles 120 will be compensated for, in order to obtain uniform print density from nozzles 120.

Returning briefly to FIG. 12, the square wave form of voltage pulse 210 is preferably used in those cases where control of print head 45 is provided digitally. That is, square wave voltage pulse 210 is preferable in those cases where the digital signal supplied to print head 45 is either "1" (e.g., for "on") or "0" (e.g., for "off").

However, one constraint or limitation on the amount of heat energy "E" supplied to ink droplet 170 is that the temperature of ink droplet 170 is preferably kept below its boiling temperature, so that nozzles 120 will not be blocked by coalescence of bubbles. As described more fully hereinbelow, a different pulse wave form is substituted for the square wave form of FIG. 12 in order to mitigate formation of voids or bubbles.

Figure 18:
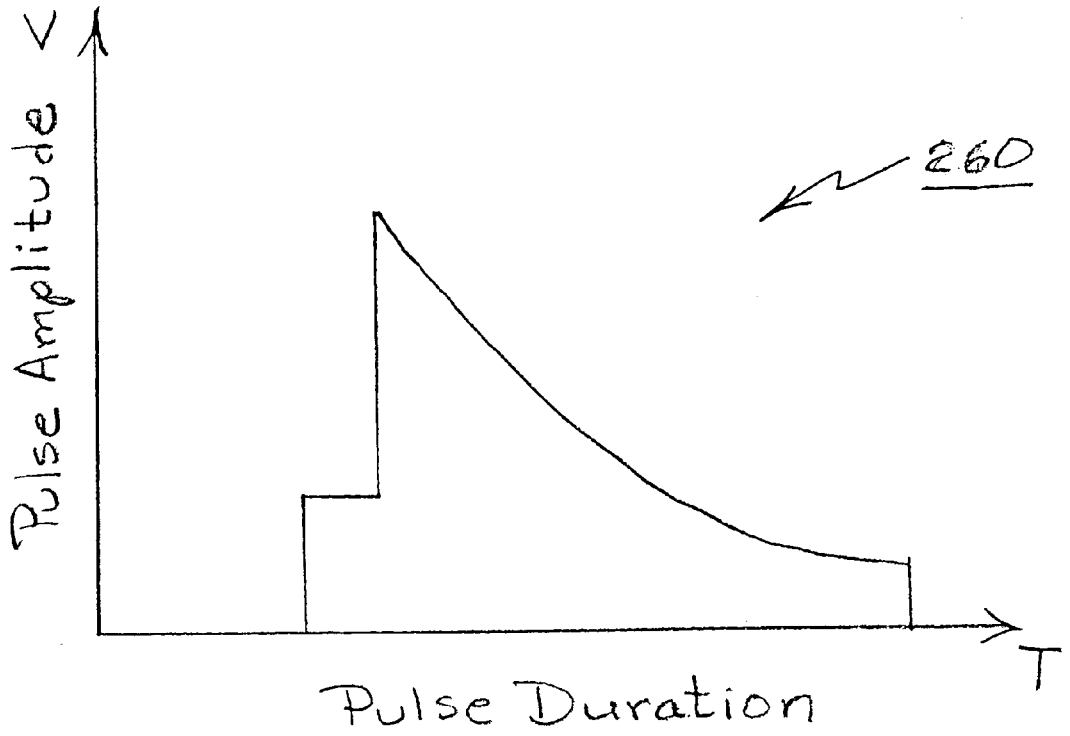
FIG. 18 is a graph illustrating a voltage pulse with a constant voltage amplitude portion and a logrithmically varying amplitude portion.

Therefore, referring to FIG. 18, in order to mitigate formation of bubbles, an analog wave form 260 may be used. Analog wave form 260 has a low voltage preheat region to warm-up ink droplet 170, a peak voltage, and then a logrithmically decreasing voltage region. Analog wave form 260 will allow ink droplet 170 to be released from nozzle 120 without excessive heating, so that significant void formation is precluded. It is understood that analog wave form 260 may be substituted for the square wave form 210, if desired.

It is appreciated from the teachings herein, that an advantage of the present invention is that images of uniform print density are provided even in the presence of variations in such factors as electrical resistance of the heaters and/or diameter of the nozzle orifice. This is so because each nozzle 120 is calibrated by means of either the Resistance Calibration Technique or by means of the Density Calibration Technique to compensate for such variability among nozzles 120.

Another advantage of the present invention is that use thereof saves time because correcting print density non-uniformities for each input image file is not required. That is, image processing is not required for each and every input image for which output density correction is desired. This is so because print head 45 is preferably calibrated once, such as at manufacture, rather than each time an image file is acquired by input source 30.

A further advantage of the present invention is that it eliminates visual printing defects, such as "banding". Of course, this is so because the print nozzles print with uniform density.

While the invention has been described with particular reference to a preferred embodiment, it will be understood by those skilled in the art that various changes may be made and equivalents may be substituted for elements of the preferred embodiment without departing from the invention. In addition, many modifications may be made to adapt a particular situation and material to a teaching of the present invention without departing from the essential teachings of the invention. For example, the invention is described with reference to a scanner or computer being used to provide the input image. However, any suitable input imaging device may be used to provide the input image. As another example, the invention is described with reference to an ink-jet printer. However, the invention may be used, with obvious modifications, in a so-called "thermal dye" printer. As a further example, the image forming characteristic is print density in the preferred embodiment of the invention. However, any applicable image forming characteristic may be selected, such as ink droplet volume.

Therefore, what is provided is an imaging apparatus and method for providing images of uniform print density, so that printing non-uniformities, such as banding, are avoided.

The invention has been described in detail with particular reference to certain preferred embodiments thereof, but it will be understood that variations and modifications can be effected within the spirit and scope of the invention.

Parts List

10 . . . imaging apparatus
20 . . . printer
30 . . . input device
40 . . . controller
45 . . . print head
50 . . . recorder medium
60 . . . rollers
70 . . . input supply tray
80 . . . output tray
90 . . . ink fluid cavities
100 . . . body of ink
110 . . . ink fluid reservoir
120 . . . nozzle
130 . . . flow channel
140 . . . orifice portion
150 . . . heater
160 . . . voltage supply unit
170 . . . droplet
180 . . . test image
190 . . . density patches
200 . . . marginal region
210 . . . square wave voltage pulse
220 . . . memory unit/chip

230 . . . first look-up table
240 . . . second look-up table
250 . . . flow chart
260 . . . analog wave form

What is claimed is:

1. An imaging apparatus comprising:

(a) a plurality of nozzles, each of said nozzles defining a fluid cavity capable of containing print fluid therein having a boiling temperature, the nozzles each terminating in an outlet wherein a meniscus of the print fluid has a predetermined surface tension that is changed in response to heat;

(b) a plurality of heater elements adapted to be in heat transfer communication with the print fluid menisci for heating the print fluid menisci so that the surface tension of the print fluid menisci relax as said heater elements heat the print fluid menisci, each of said heater elements being adapted to receive a predetermined voltage pulse;

(c) a voltage supply unit associated with said heater elements for supplying a respective predetermined voltage pulse to each of said heater elements, each voltage pulse having a predetermined pulse amplitude and a predetermined pulse duration, so that each of said heater elements selected for generation of a drop heats the print fluid meniscus as the voltage pulse is supplied, and so that the surface tension decreases as the print fluid meniscus is heated to below the boiling temperature of the print fluid, and so that the print fluid is released from the fluid cavities as a drop as the surface tension decreases; and (d) a controller interconnecting said heater elements and said voltage supply unit for controlling the voltage pulse supplied to each of said heater elements, so that the voltage pulses supplied to some of said heater elements selected for generation of drops to be printed at the same density and color are provided with different amplitudes to correct for nonuniformities in operation of respective nozzles.

2. The imaging apparatus of claim 1, further comprising a memory unit connected to said controller for storing data related to pulse amplitude values, and in response to an input request to said memory unit of data representing a density value to be printed by a nozzle, said memory unit is accessed for corresponding data related to pulse amplitude value in order to communicate to said controller data related to the pulse amplitude for the print density requested for such nozzle, and wherein the memory unit stores data related to different amplitudes values, and data related to amplitude values communicated to said controller for at least some of said nozzles, in response to data requests representing the same density value to the memory unit, are different to provide instructions to the controller for different amplitude values to compensate for nonuniformities in the nozzles.

3. The imaging apparatus of claim 2 and wherein a memory unit stores data related to pulse duration, and in response to an input request to the pulse duration storing memory unit of data representing a density value to be printed by a nozzle, said pulse duration storing memory unit is accessed for corresponding data related to pulse duration value in order to communicate to said controller data related to the pulse duration for the print density requested for such nozzle, and wherein the pulse duration storing memory unit stores data related to different pulse duration values, and data related to pulse duration values communicated to said controller for at least some of said nozzles, in response to data requests representing the same density value to the memory unit, are different to provide instructions to the controller for different pulse duration values to compensate for nonuniformities in the nozzles.

4. The imaging apparatus of claim 3 and wherein the voltage supply unit provides to the heater element a voltage pulse having a portion whose amplitude logarithmically decreases with time.

5. The imaging apparatus of claim 2 and wherein the voltage supply unit provides to the heater element a voltage pulse having a portion whose amplitude logarithmically decreases with time.

6. The imaging apparatus of claim 1 and wherein the voltage supply unit provides to the heater element a voltage pulse having a portion whose amplitude logarithmically decreases with time.

7. An imaging method for generating dots of uniform density:

providing a plurality of nozzles, each of said nozzles defining a fluid cavity capable of containing print fluid therein having a boiling temperature, the nozzles each terminating in an outlet wherein a meniscus of the print fluid has a predetermined surface tension that is changed in response to heat;

selectively activating heater elements in heat transfer communication with the print fluid menisci at selected outlets and heating the print fluid menisci so that the surface tension of the print fluid menisci relax as said heater elements heat the print fluid menisci at the selected outlets;

supplying a respective predetermined voltage pulse to each of said heater elements, each voltage pulse having a predetermined pulse amplitude and a predetermined pulse duration, so that each of said heater elements selected for generation of a drop at a selected outlet heats the print fluid meniscus as the voltage pulse is supplied, the voltage pulse supplied heating the print fluid meniscus to below the boiling temperature of the print fluid so that the print fluid is released from a fluid cavity of a selected outlet as a drop as the surface tension decreases; and wherein voltage pulses supplied to at least some of said heater elements selected for generation of drops to be printed at the same density and color are provided with different pulse amplitudes to correct for nonuniformities in operation of respective nozzles.

8. The imaging method of claim 7 and wherein a memory unit stores data related to pulse amplitude values, and in response to an input request to said memory unit data representing a density value to be printed by a nozzle, said memory unit provides corresponding data related to pulse amplitude value to a controller for the print density requested for such nozzle, and wherein the memory unit stores data related to different amplitude values, and data in response to data requests representing the same density value to the memory unit, are different to provide instructions to the controller for different amplitude values to compensate for nonuniformities of the nozzles.

9. The imaging method of claim and wherein a memory unit stores data related to pulse duration values, and in response to an input request to said pulse duration storing memory unit of data representing a density value to be printed by a nozzle, said pulse duration storing memory unit provides corresponding data related to pulse duration value and outputs to a controller data related to pulse duration for the print density requested for such nozzle, and wherein the pulse duration storing memory unit stores data related to different pulse duration values, and data related to pulse duration values output to said controller for at least some of said nozzles, in response to data requests representing the same density value to the pulse duration storing memory unit, are different to provide instructions to the controller for different pulse duration values to compensate for nonuniformities in the nozzles.

10. The imaging method of claim 9 and wherein the heater element receives a voltage pulse having a portion whose amplitude logarithmically decreases with time.

11. The imaging method of claim 8 and wherein the heater element receives a voltage pulse having a portion whose amplitude logarithmically decreases with time.

12. The imaging method of claim 8 and wherein the memory unit stores data relating to different pulse amplitude values for different values of input density of drops to be formed.

13. The imaging method of claim 7 and wherein the heater element receives a voltage pulse having a portion whose amplitude logarithmically decreases with time.

* * * * *